United States Patent [19]

Lecourtois, Eugene

[11] Patent Number: 4,806,121

[45] Date of Patent: Feb. 21, 1989

[54] CONTACT SOCKET ELEMENT, STRIP COMPRISING IT AND ITS MANUFACTURING

[75] Inventor: Lecourtois, Eugene, Evry, France

[73] Assignee: N.E.D. Nicomatic Electronic Department, France

[21] Appl. No.: 171,426

[22] PCT Filed: Jul. 9, 1987

[86] PCT No.: PCT/FR87/00276

§ 371 Date: Mar. 9, 1988

§ 102(e) Date: Mar. 9, 1988

[87] PCT Pub. No.: WO88/00762

PCT Pub. Date: Jan. 28, 1988

[30] Foreign Application Priority Data

Jul. 11, 1986 [FR] France ..... 86 10183

[51] Int. Cl.[4] ..... H01R 4/24

[52] U.S. Cl. ..... 439/417

[58] Field of Search ..... 439/391–425

[56] References Cited

U.S. PATENT DOCUMENTS

| | | | |
|---|---|---|---|
| 3,047,832 | 7/1962 | Deakin . | |
| 3,806,859 | 1/1971 | Madarasz et al. . | |
| 4,106,836 | 8/1978 | Asick et al. | 439/422 |
| 4,211,466 | 7/1980 | Reynolds | 439/422 |
| 4,263,474 | 4/1981 | Tennant | 439/422 |

FOREIGN PATENT DOCUMENTS

| | | |
|---|---|---|
| 2644612 | 4/1978 | Fed. Rep. of Germany . |
| 2040371 | 1/1971 | France . |
| 1459694 | 12/1976 | United Kingdom . |

*Primary Examiner*—J. H. McGlynn

*Attorney, Agent, or Firm*—Larson and Taylor

[57] ABSTRACT

Contact elements placed side by side along a carrier strip (10) and comprising a plugging part (12) provided with elastic flanges (22) intended to clamp a plug contact element. A backwards-projecting tongue (26) locks the contact element in a connector body. The junction part (14) is provided with plunged bosses (32) which form teeth (34, 36) intended to pass through flexible printed circuits. Application in the manufacturing of connectors for flexible printed circuits.

10 Claims, 1 Drawing Sheet

2
16
10
18
20
24
26
22
12
28
34
32
36
14
2

38
10
16
44
40
42

10
18
24
26
22
28
34
14
36
34
36

46
48
50
52

CONTACT SOCKET ELEMENT, STRIP COMPRISING IT AND ITS MANUFACTURING PROCESS

The present invention generally concerns junctions and particularly concerns contact socket elements, strips comprising such elements juxtaposed thereon, and the manufacturing process of such a strip.

Contact elements, both male and female, or plug and socket, are already known formed from blanks cut from sheets of metal. The elements are often formed by rolling or bending following cutting and they are often presented placed side by side, along a carrier strip which supports them and which usually comprises handling openings.

Because of the growing tendency toward miniaturization, the surface areas of the contacts of connectors have had to be, over some time, of progressively smaller size. A surface area now presently being used is 2.54 mm. Present cutting and bending techniques of metal sheets do not allow the formation of juxtaposed contacts with a sufficient amount of material for establishment of a secure connection. Consequently, the contact elements of connectors with corresponding surface areas which are as small as desired at the present time are either formed in a part of a strip of greater width than the surface area, or formed from several strips together.

The invention concerns contacts which can be formed entirely with the metal contained in the piece of metal strip corresponding to the surface area of the connectors. More precisely, all of the parts of a contact socket element are realized from a piece of strip of which the width is equal to the surface area of the contacts of the connectors.

The invention thus concerns not only the contact socket elements but also the unbroken strips comprising the socket elements placed side by side on and supported by a carrier strip advantageously comprising handling openings. The invention also concerns a process for the manufacture of such a strip.

More precisely, the invention concerns a contact socket element of one single piece for a connector, of the type which comprises a plugging part and a junction part, both of them formed from one metal sheet; the plugging part comprises two flexible cheeks placed facing each other and demarcating a lodging for a male contact element, the plug, with the inside surfaces of the cheeks being intended to be in contact with a plug contact element, an external guard flange placed at the end of the plugging part which is opposite the junction part and integral with the two cheeks of one side of the lodging demarcated by the two cheeks, an internal guard flange placed at the other end of the plugging part which is near the junction part and integral with the two cheeks on the same side of the lodging as the external guard flange, and a small flexible tongue having one end integral with the external guard flange and one free end extending toward the internal guard flange, the small tongue being at some distance from said lodging from its end integral with the external guard flange toward its free end.

It is advantageous that the cheeks be curved convexly toward the lodging of the plug element. In one advantageous embodiment, the junction part is flat and comprises at least one carved out spot of rectangular shape, the carved flaps forming two teeth at facing edges of the carved out spot and defined by complementary edges, each tooth being arranged transverse to the junction part. It is advantageous that the junction part comprise two carved out spots. These preferably have complementary shapes in a V formation, so that one of the teeth has one point and the other has two points.

The invention also concerns a strip of contact socket elements of the aforementioned type, formed of one single piece of a metal sheet; the strip comprises a carrier strip having handling openings, the external guard flange of the socket contact elements being integral with the carrier strip, the total of the widths of the external guard flange and the cheeks, at the point where they are integral with the external guard flange, being equal to the surface area of the contact socket elements along the carrier strip.

It is also advantageous that the total of the widths of the internal guard flange and the cheeks, at the point where they are integral with this guard flange, be equal to the surface area of the contact socket elements along the strip. The junction part can be narrower or be equal to the surface area of the socket elements. The invention also concerns a process for the manufacture of such a strip, from a metal strip, comprising the separation of a part which is intended to form the carrier strip from the parts intended to form the cheeks, the separation of the part intended to form the small tongue on all of its sides except the side of the external guard flange, and the separation of the contact socket elements from each other by a shearing operation without loss of material, along the external edges of the cheeks.

It is also advantageous that the carved out spots of the junction parts, where they exist, also be formed by shearing.

Thus, the use of shearing to form the edges which demarcate the width of each blank from which a contact socket element is formed allows for optimum use of the material of the strip and the realization of the contact elements with a very reduced surface area, for instance of 2.54 mm, without contribution of outside material.

Other characteristics and advantages of the invention will arise from the following description, made in reference to the attached drawings, wherein.

Figures 1, 2, 3, 4, 5:
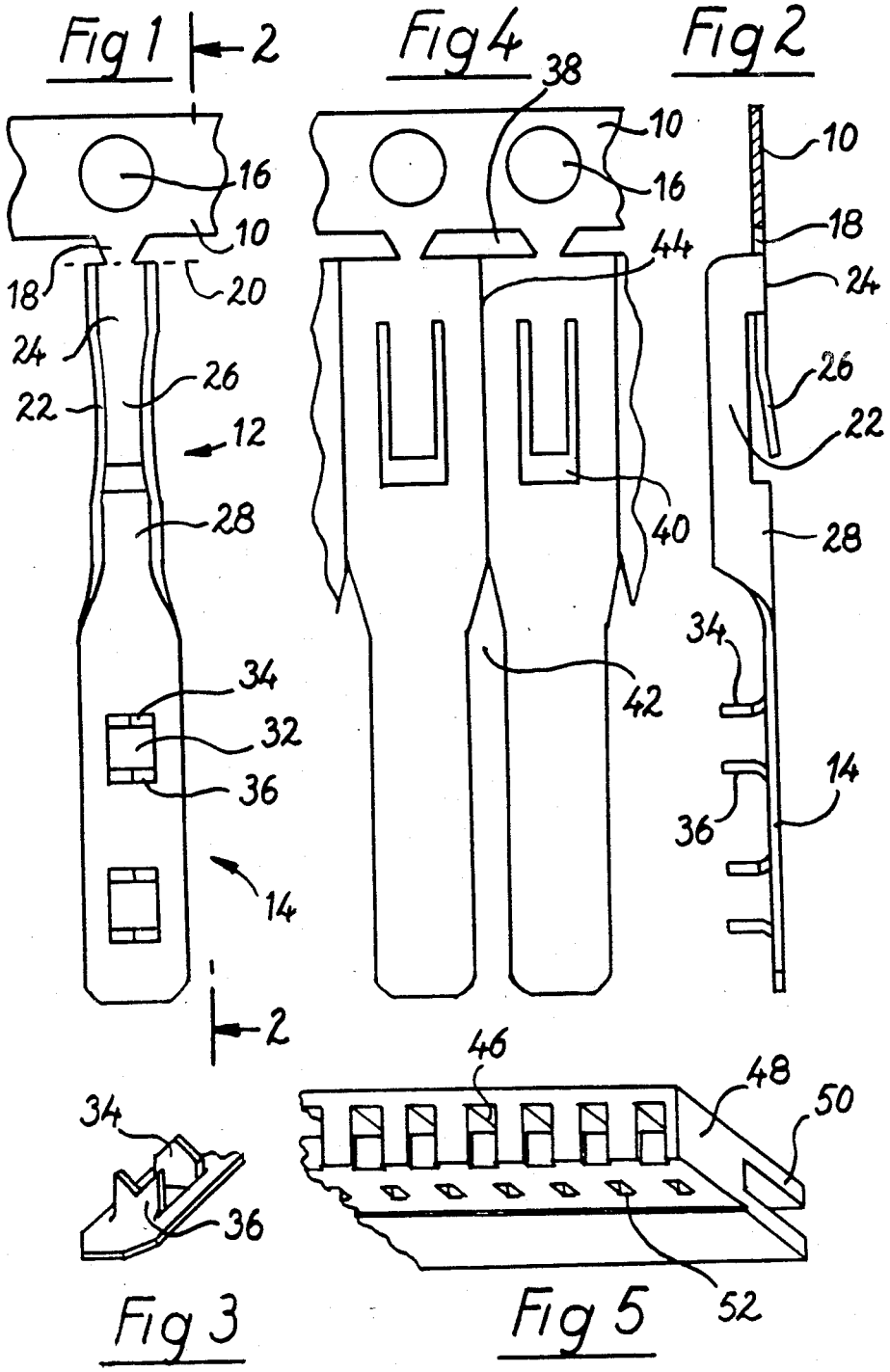
FIG. 1 is a planar view of a contact socket element according to the invention, completed, shown as it may be separated from a carrier strip.
FIG. 2 is a side elevation in partial cross section along line 2—2 of FIG. 1.
FIG. 3 is a partial perspective representing a carved out spot formed in a junction part of a contact socket element of the invention.
FIG. 4 shows a metal strip in the course of the manufacture of the contact elements shown in FIGS. 1 to 3.
FIG. 5 is a perspective of a connector block intended to contain the contact socket elements of FIGS. 1 to 3.

FIGS. 1 and 2 show a contact socket element according to the invention entirely completed, shown as they are connected but may be separated from a carrier strip. More precisely, the carrier strip is 10 and it is connected to the contact socket element which comprises a plugging part 12 and a junction part 14. Carrier strip 10 has handling openings 16 allowing for precise positioning, and a collar 18 to which is connected plugging part 12.

The contact socket element can be totally separated by cutting along broken line 20.

Plugging part 12 comprises two flexible cheeks 22. FIG. 1 shows that the central part of each cheek is slightly convex, its convexity turned toward the interior of the contact element, in other words toward the lodging provided for a contact plug element. The external and internal parts of the cheeks are connected by an external guard flange 24 and an internal guard flange 28. The cheeks are free between the two catch guards. A small tongue 26 extends from guard flange 24 and is separated from the lodging provided for a contact plug element.

Junction part 14 extends from internal guard flange 28 and has two carved out spots 32. Each carved out spot is formed by shearing of the material and formation of two teeth 34 and 36, having edges of complementary shape, tooth 34 forming one point and tooth 36 forming two points. Although two carved out spots have been shown, junction part 14 can have any desired number of carved out spots. However it is important to note that teeth 34 and 36 of the carved out spots are oriented transverse to the length of the contact socket element. This arrangement is important according to the invention because it allows for bending or crimping of teeth 34 and 36, after they have penetrated through a flexible printed circuit, in the course of an operation which permits the bending of all of the teeth of some plurality of contact socket elements placed side by side. If teeth 34 and 36 were placed on the two other sides of the carved out spots, they would have to be folded separately for each contact element.

When tooth 36 passes through a flexible circuit, the two points have a tendency to separate from each other. According to one advantageous feature of the invention, the point at the bottom of the groove separating the two points is sufficiently near the base of the tooth that this separation of the two points pushes back their external edge at the contact of the flexible circuit and thus improves the quality of the electric contact which is obtained.

FIG. 4 shows a metal strip having already been subjected to some of the operations in the course of its manufacture according to the process of the invention. It is to be noted that carrier strip 10 has already been formed, with handling openings 16. However it is to be noted that, by removal of material, openings 38 have been formed in the part between the adjacent fixation parts of adjacent socket elements. A cut 40 is also to be noted which defines the contour of small tongue 26 and on the other hand which disengages one edge of cheeks 22, at the suitable distance. Finally, some material has also been removed in area 42 between the junction parts of the two adjacent elements.

According to one essential characteristic of the process of the invention, the blanks of the elements according to the invention are sheared apart along line 44, in other words are separated by a simple separation step, without removal of material. This feature is important because it allows the realization of contact socket elements with a very small surface area, for instance of 2.54 mm. In one corresponding embodiment with the contact socket elements having a surface area of 2.54 mm, the cheeks are of 0.7 mm width and the junction parts are of 1.8 mm width. The material is a sheet of bronze or brass, of a well known type in technology, of for instance 0.2 mm thickness.

When the junction part comprises carved out spots, the material must be sufficiently rigid that the points perforate the flexible circuit or other substrate which must be passed through. Also, the angles of the points must be as sharp as possible.

FIG. 5 is a perspective of the end of the cast element of a connector intended to lodge contact socket elements, lodged in terms of one element per passage 46 of the cast element. The surface area of passages 46 is 2.54 mm. The member 48 is terminated, on the side of the junction parts, by two continuous cheeks 50 which surround junction parts 14 of which the points have passed through a flexible printed circuit sheet. Besides, the small openings 52 formed opposite each passage 46 and intended to block small tongue 26 of the corresponding contact should also be noted.

I claim:

1. Contact socket element of one single piece, for connector, of the type which comprises a plugging part (12) and a junction part (14), both formed from one single metal sheet, characterized in that the junction part (14) is flat and comprises at least one carved out spot (32) of rectangular shape, having two teeth (34, 36) at opposite edges of the carved out spot and defined by complementary edges, each tooth being arranged transverse to the junction part.

2. Element as in claim 1, characterized in that it comprises two carved out spots in the junction part.

3. Element as in claim 1 characterized in that the teeth (34, 36) of the carved out spots have complementary edges in V formation, one of the teeth having one point and the other two points.

4. Element as in claim 3, characterized in that the point of the V is near the base of the tooth (36) so that the two points start to separate from each other in the vicinity of the base.

5. Element as in claim 1, characterized in that the plugging part (12) comprises:

two flexible cheeks (22) placed one facing the other and demarcating a lodging of a contact plug element, the internal surface area of the cheeks being intended to be in contact with a contact plug element, an external guard flange (24) placed at the end of the plugging part which is opposite the junction part, and integral with the two cheeks of one side of the lodging demarcated by the two cheeks, an internal guard flange (28) placed at the end of the plugging part which is near the junction part and integral with the two cheeks of the same side of said lodging as the external guard flange, and a small flexible tongue (26) having one part integral with the external guard flange and one free end extending toward the internal guard flange, the small tongue being separated from said lodging from its end integral with the external guard flange toward its free end.

6. Element as in claim 5, characterized in that the cheeks (22) have a convex shape curved inward toward the lodging of the plug element.

7. Strip of contact socket elements as in claim 5, the strip being formed of one single piece from a metal sheet, characterized in that it comprises a carrier strip (10) having handling openings (16), the external catch guards (24) of the contact socket elements being integral with the carrier strip, the sum of the widths of the external guard flange (24) and the cheeks of an element at the point where they are integral with the external guard flange being equal to the surface area of the contact socket elements along the carrier strip.

8. Strip as in claim 7, characterized in that the sum of the widths of the internal guard flange (28) and the cheeks (22) at the point where they are integral with this guard flange is equal to the surface area of the contact socket elements.

9. Process for the manufacture of a strip of contact socket elements as in claim 7, characterized in that it comprises, in a metal strip :

the separation of a part intended to form the carrier strip from parts intended to form the cheeks (22), the separation of a part on all of its sides except from the side of the external guard flange (24) in order to form a small tongue (26), and the separation of the contact socket elements from each other by a shearing operation without loss of material, along the external edges (44) of the cheeks.

10. Process as in claim 9, characterized in that it comprises, besides the formation of carved out spots (32) in the junction part, the carved out spots being formed by shearing.

* * * * *